US005820469A

United States Patent [19]

Nobbs, Jr.

[11] Patent Number: 5,820,469

[45] Date of Patent: Oct. 13, 1998

[54] FLYING VEHICLE RIDE

[75] Inventor: Wayne A. Nobbs, Jr., Hutchinson, Kans.

[73] Assignee: Chance Industries, Inc., Wichita, Kans.

[21] Appl. No.: 866,175

[22] Filed: May 30, 1997

[51] Int. Cl.[6] ..... A63G 1/28

[52] U.S. Cl. ..... 472/33; 472/3

[58] Field of Search ..... 472/29, 32, 33, 472/47, 3, 130

[56] References Cited

U.S. PATENT DOCUMENTS

| | | | |
|---|---|---|---|
| 2,142,169 | 1/1939 | Bisch | 472/33 |
| 3,603,583 | 9/1971 | Bartlett . | |
| 4,576,373 | 3/1986 | Spieldiener et al. | 472/33 |
| 4,842,267 | 6/1989 | Kastner | 472/33 |
| 4,898,377 | 2/1990 | Roche . | |

OTHER PUBLICATIONS

Fly–O–Plane, manufactured by Eyerly Aircraft Co., 1946.
Flying Scooters, manufactured by Bisch–Rocco Amusement Co., 1930.
Aerial Joy Ride, manufactured by Spillman Engineering Corp., 1935.

*Primary Examiner*—Kien T. Nguyen
*Attorney, Agent, or Firm*—Shook, Hardy & Bacon L.L.P.

[57] ABSTRACT

A flying vehicle ride includes an upstanding tower and a plurality of flying vehicles suspended from the tower for rotation about a vertical axis. The flying vehicles each include a pair of wings that are movable under the control of the rider between a neutral position, a first lift generating position in which the wings generate outward lift, and a second lift generating position in which the wings generate inward lift. As such, manipulation of the wings during rotation of the vehicle about the tower generates lift that alters the path of travel of the vehicle, permitting the rider to move the vehicle higher or lower relative to the tower than would otherwise be possible.

15 Claims, 5 Drawing Sheets

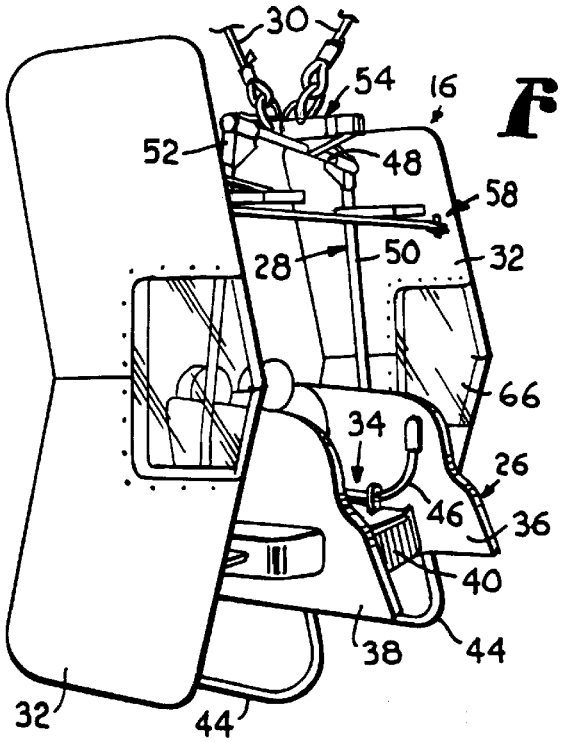
Fig.3.
Fig.4.
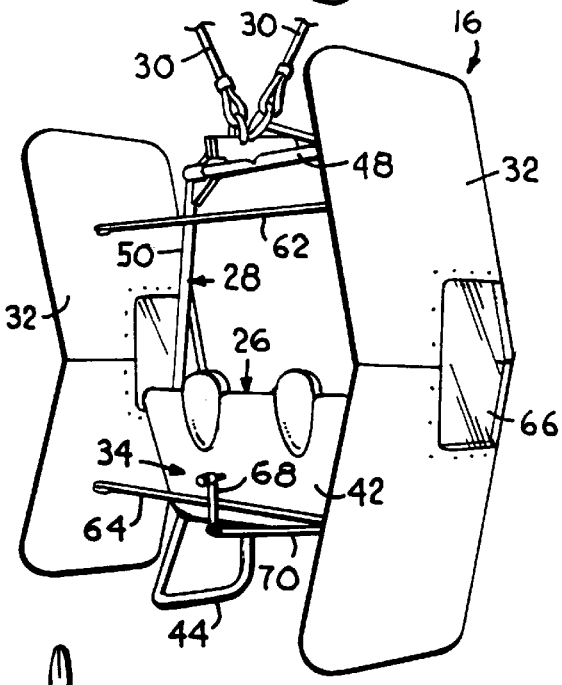
Fig.5.
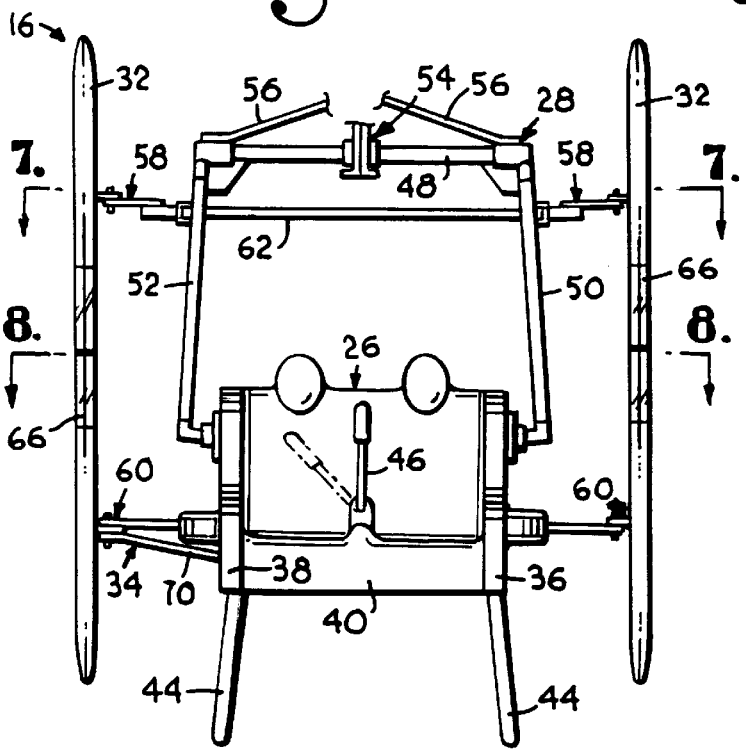

FLYING VEHICLE RIDE

BACKGROUND OF THE INVENTION

The present invention relates generally to amusement rides, and more particularly to a ride having flying vehicles with manually controlled lift-generating wings.

It is known to provide a roundabout having an upstanding tower, a plurality of sweeps supported on the tower for rotation about a vertical axis, a motor or engine for driving rotation of the sweeps, and a plurality of cars for carrying occupants around the tower during rotation of the sweeps. Improvements in this basic type of amusement ride have resulted in many diverse car constructions, each attempting to provide riders with a new experience or sensation not previously available. As such, riders anticipate the development of new rides, and expect to experience new thrills as the art evolves and as new rides are introduced.

SUMMARY OF THE INVENTION

It is an object of the present invention to provide a flying vehicle ride that delivers an experience to riders that cannot be experienced in conventional rides, and that includes flying vehicles with wings that can be controlled by the rider to effect bidirectional lift of the vehicle so that the rider can alter the path of travel of the vehicle inward or outward of a circular path that would otherwise be followed in the absence of such lift.

In accordance with these and other objects evident from the following description of a preferred embodiment of the invention, the ride includes an upstanding tower defining a vertical axis, a plurality of sweeps supported on the tower for rotation about the vertical axis, and a drive means for driving rotation of the sweeps. A flying vehicle is suspended from the sweeps and includes a pair of wings that are movable between a neutral position, a first lift generating position in which the wings generate outward lift, and a second lift generating position in which the wings generate inward lift. In addition, the vehicle includes a manually actuated control means for controlling movement of the wings between the neutral and lift generating positions.

By providing an apparatus in accordance with the present invention, numerous advantages are realized. For example, by providing a vehicle having a pair of wings that generate lift when moved in either direction from the neutral position, it is possible for a rider to alter the path of travel of the vehicle, moving the vehicle higher or lower relative to the tower than would otherwise be possible if no lift were generated.

BRIEF DESCRIPTION OF THE DRAWING

The preferred embodiment of the present invention is described in detail below with reference to the attached drawing figures, wherein:

FIG. 3 is a side perspective view of a flying vehicle forming a part of the ride;

FIG. 4 is a rear perspective view of the vehicle;

FIG. 5 is a front elevational view of the vehicle;

DETAILED DESCRIPTION OF THE PREFERRED EMBODIMENT

Figure 1:
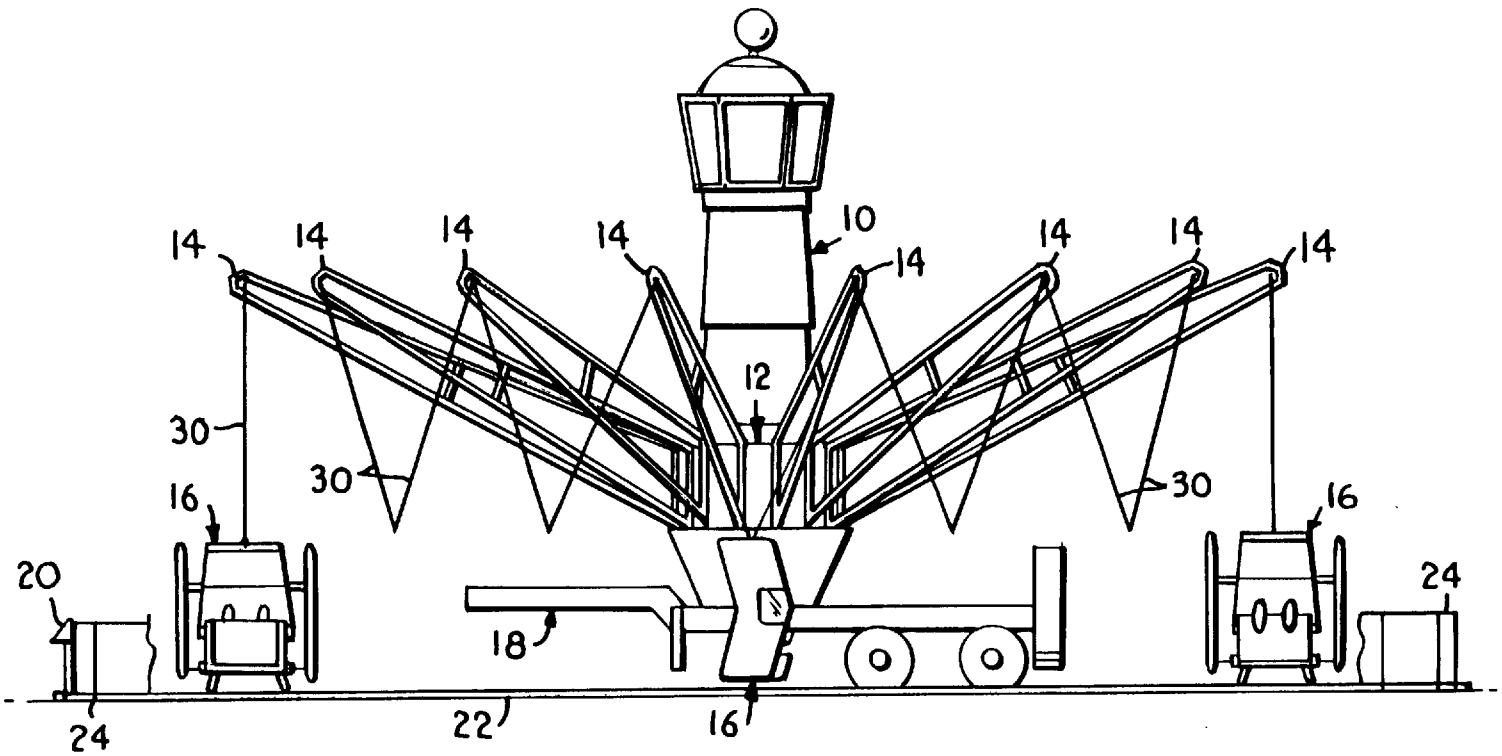
FIG. 1 is a front elevational view of a flying vehicle ride constructed in accordance with the preferred embodiment, illustrating the ride during loading.

A flying vehicle ride constructed in accordance with the preferred embodiment is illustrated in FIG. 1, and broadly includes a tower 10, a hub 12 supported on the tower for rotation about a vertical axis, a plurality of sweeps 14 secured to the hub and protruding radially outward from the tower, and a plurality of flying vehicles 16 suspended from the sweeps.

The tower 10 is supported on a trailer 18 so that the ride can be transported from location to location, but remains stationary during operation of the ride. An engine or other suitable drive means is housed on the trailer within the tower for driving rotation of the hub, and is controlled from a control panel 20 that can be positioned at a remote location from the trailer. A platform 22 may be provided for presenting a level, horizontal support surface on which the vehicles sit during loading of the ride, and a fence 24 surrounds the ride so that spectators are kept a predetermined distance from the vehicles.

The hub 12 is supported on the tower 10 by a conventional bearing assembly, and rotates about the central vertical axis of the tower under power from the drive means. The sweeps 14 are fixed on the hub 12 and extend upward and radially outward from the tower, each presenting a distal end from which one or more of the vehicles 16 is suspended. If desired, the sweeps can also be raised and lowered on the hub relative to the tower to raise the vehicles off of the ground at the beginning of the ride after loading is completed, and to lower the vehicles to the platform or ground at the end of the ride.

As shown in FIG. 5, each vehicle 16 broadly includes a seat 26, an inverted U-shaped frame 28 that is suspended between two of the sweeps by a pair of cables 30, shown in FIG. 3, a pair of laterally spaced, vertically extending wings 32 connected to the seat and frame for relative shifting movement about substantially vertical, parallel axes, and a control mechanism 34 for controlling the movement of the wings.

The seat 26 is preferably formed of synthetic resin material or fiberglass, and includes side-by-side seating for two riders. The seat presents inboard and outboard sides 36, 38, as well as a front side 40 shown in FIG. 5, and a back side 42, shown in FIG. 4. In addition, skids 44 or other suitable landing gear are provided beneath the seat for supporting the seat above the ground during loading. A center console is provided on the seat, and a handle 46 of the control mechanism is supported on the console within easy access by either rider. As shown in FIG. 3, the handle includes a generally horizontally extending shaft having a forward end that is turned upward to present a crank by which the shaft can be rotated about its axis. However, a joystick or other known type of actuator could be employed in place of the illustrated handle.

Figure 2:
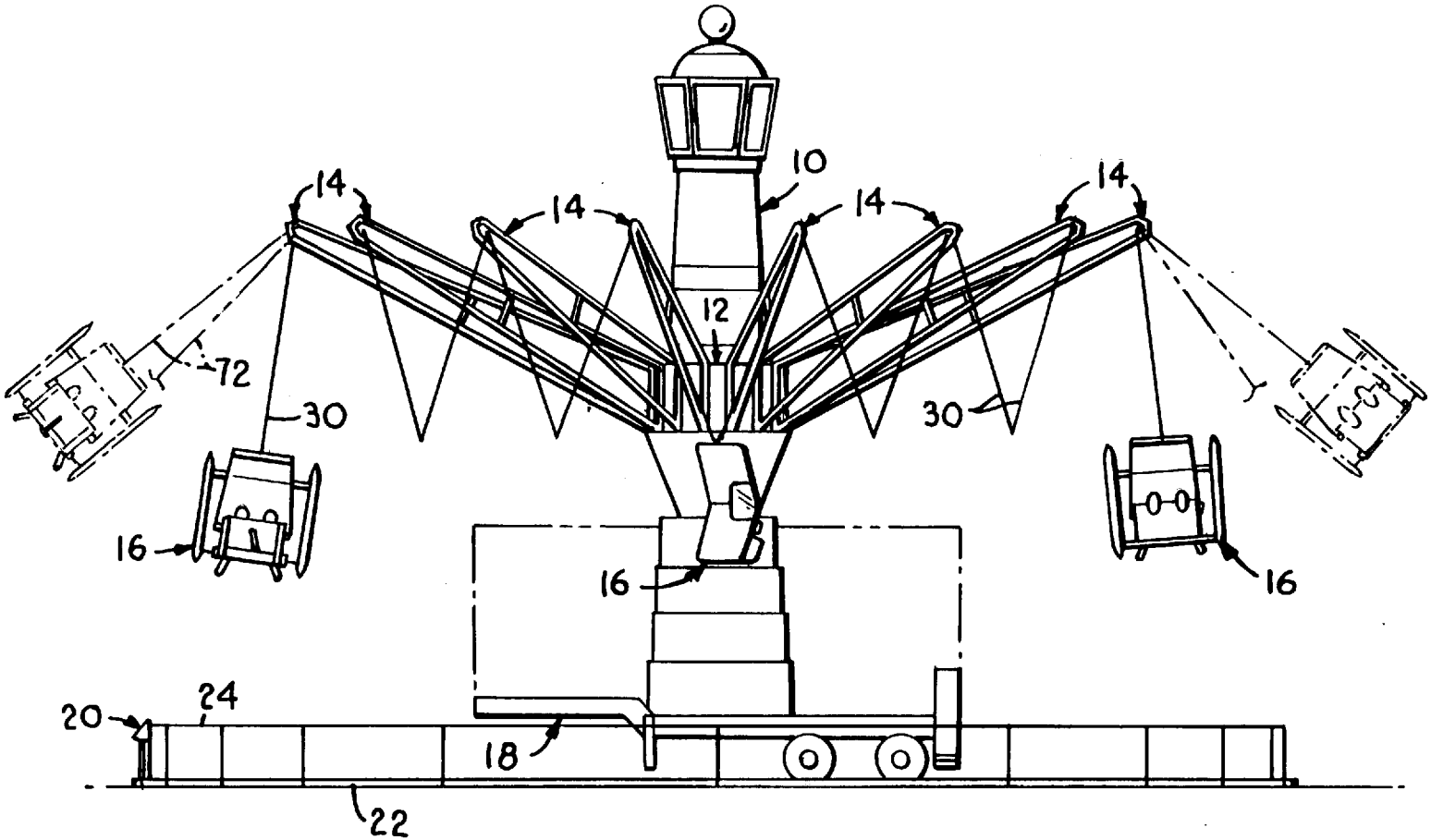
FIG. 2 is a front elevational view of the ride, illustrating a pair of flying vehicles being rotated about a vertical axis of the ride.

Returning to FIG. 5, the U-shaped frame 28 includes an upper bar 48 and two depending side bars 50, 52. The vehicle is suspended from the sweeps so that the upper bar is oriented radially of the vertical axis of the tower, as shown in FIG. 2, and the two legs present lower ends that are secured to the inboard and outboard sides of the seat so that the seat and frame are fixed relative to one another. Alternately, the frame can extend from front to back rather than from side to side, with the lower ends of the legs of the frame secured to the front and back sides of the seat.

As illustrated in FIG. 4, the upper bar 48 includes a bracket 54 extending transverse to the length of the bar, and the bracket includes holes by which the frame is connected to the two cables 30 suspended from adjacent sweeps of the hub. As such, each vehicle is suspended between a pair of adjacent sweeps rather than from a single sweep. A pair of reinforcing bars 56, shown in FIG. 5, can also be provided between the upper bar of the frame and the bracket for reinforcing the bracket.

Figure 6:
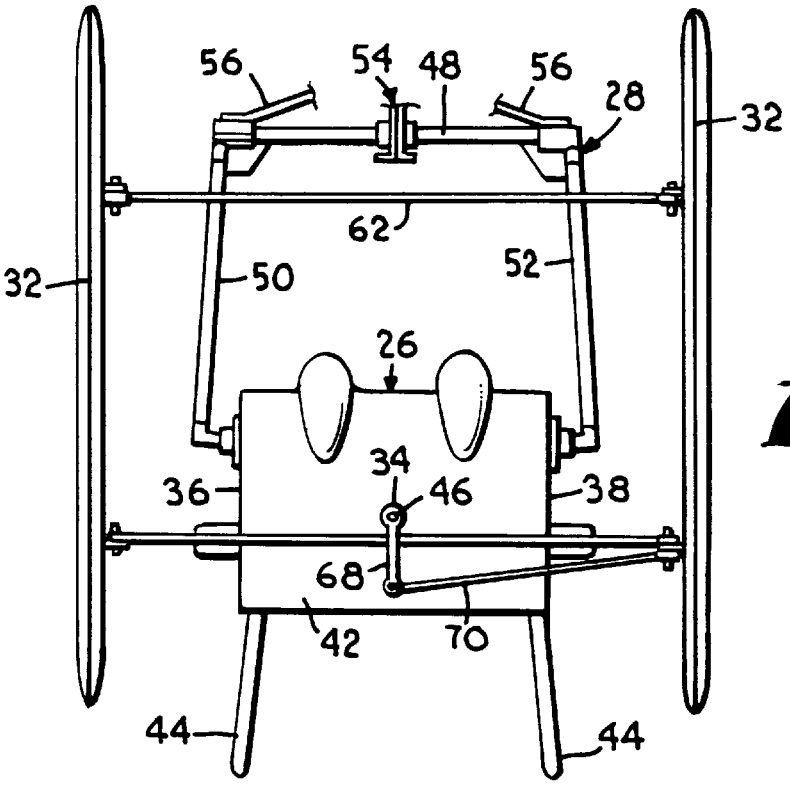
FIG. 6 is a rear elevational view of the vehicle.

The wings 32 are substantially identical to one another, and each is connected to the seat 26 and frame 28 of the vehicle by upper and lower hinges 58, 60, as shown in FIG. 5, which permit the wing to pivot about a substantially vertical axis that is defined by the hinges. As illustrated in FIG. 6, upper and lower stabilizer bars 62, 64 extend between and connect the wings together, and maintain the wings substantially parallel to one another at all times. The stabilizer bars 62, 64 are secured to the wings 32 through pivot pins that permit the wings to pivot about the hinges 58, 60 while maintaining the wings parallel.

Figure 8:
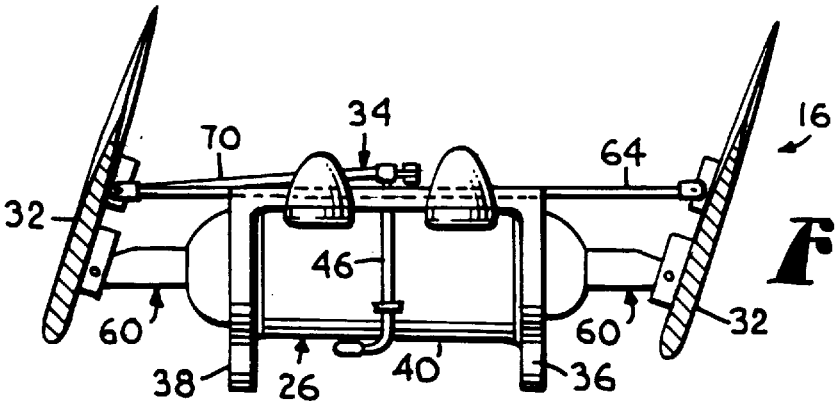
FIG. 8 is a sectional view of the vehicle taken along line 8—8 of FIG. 5.

As shown in FIG. 8, each wing 32 includes a cross-sectional profile presenting a center chord and symmetrical inboard and outboard airfoil surfaces that produce lift when the angle of attack of the wing is increased by pivoting the wing about the hinges. The symmetrical shape is required to provide lift in both lateral directions of the vehicle so that the riders are able to direct the vehicle either higher or lower relative to the ground than would otherwise be possible.

One of the wings, preferably the inboard wing, is spaced forward of the other wing relative to the seat in order to improve the lift generated by the wings during rotation of the vehicle about the vertical axis. Although the outboard wing could be positioned forward of the inboard wing, it is preferred to move the inboard wing forward in order to widen the field of view of the rider outward from the ride during flight. In addition, this orientation facilitates loading of the vehicles. As illustrated in FIG. 3, a window 66 can be formed in one or both of the wings at eye level to the riders for further improving visibility from the vehicle, enhancing the experience of the ride.

Although the wings 32 are each illustrated as being generally chevron shaped, other shapes could also be employed within the scope of the preferred embodiment so long as the resulting construction generates lift in both lateral directions of the vehicle when the wings are pivoted about the hinges.

Figure 7:
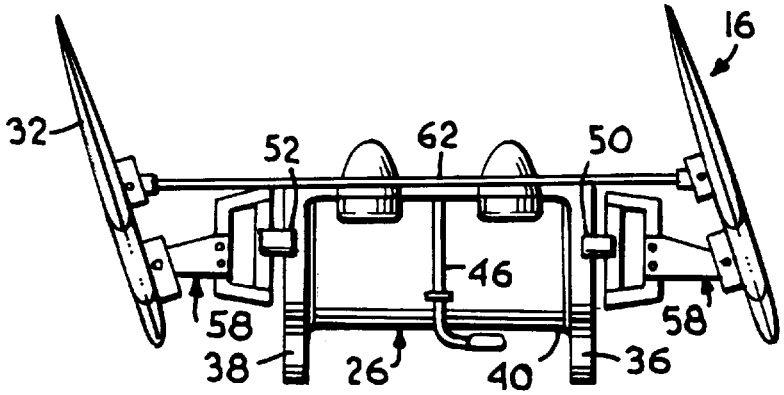
FIG. 7 is a sectional view of the vehicle taken along line 7—7 of FIG. 5.

As shown in FIG. 6, the preferred control mechanism 34 includes a moving means in the form of mechanical linkage for moving the wings in response to actuation of the handle. The moving means includes a transverse operating arm 68 secured to the rear end of the handle, and a connecting link 70 extending between the operating arm and one of the wings. With reference to FIG. 7, when the handle is rotated to the rider's left, the operating arm pushes the connecting link outward, shifting the wing counterclockwise about the pivot axis such that the wing is angled toward the inboard side of the vehicle. The stabilizer bars transmit this shifting movement to the other wing so that both wings are maintained in the same orientation relative to one another, and lift is generated by the wings that shifts the vehicle further inboard than would otherwise be the case in the absence of such lift. Likewise, as shown in FIG. 8, when the handle is rotated to the rider's right, the wings are shifted clockwise about their axes, generating lift that shifts the vehicle further outboard than would be the case if no lift were generated. Thus, manipulation of the handle 46 controls the direction of lift acting on the vehicle.

A pneumatic or electrical moving means could alternately be employed in place of the mechanical linkage to move the wings in response to the manual actuation of the rider. For example, a pneumatic means would include a flow control valve connected to the handle for controlling the flow of air under pressure to a double acting cylinder, and a connecting link extending between the cylinder and one of the wings. During operation, when the handle is rotated to the rider's left, the control valve is moved in a first direction, supplying air under pressure to a first side of the cylinder so that a piston forming a part of the cylinder pushes the connecting link outward, shifting the wing counterclockwise about the pivot axis such that the wing is angled toward the inboard side of the vehicle. The stabilizer bars transmit this shifting movement to the other wing so that both wings are maintained in the same orientation relative to one another. Likewise, when the handle is rotated to the rider's right, the valve redirects air under pressure to the other end of the cylinder, causing the piston to shift the wings clockwise about their axes.

An electrical moving means could also be used, wherein a solenoid actuator is connected to one of the wings by a connecting link, and a circuit is provided between the handle and the actuator for controlling operation of the solenoid in response to movement of the handle. During operation, when the handle is rotated to the rider's left, the circuit supplies current to the solenoid actuator to push the connecting link outward, shifting the wing counterclockwise about the pivot axis such that the wing is angled toward the inboard side of the vehicle. The stabilizer bars transmit this shifting movement to the other wing so that both wings are maintained in the same orientation relative to one another. Likewise, when the handle is rotated to the rider's right, the circuit powers the solenoid actuator to cause the wings to be shifted clockwise about their axes.

Returning to the illustrated embodiment of FIG. 1, the vehicles 16 are loaded while resting on the ground or platform and all riders are secured in their seats with conventional restraints. Thereafter, the vehicles are lifted from the platform, or the platform lowered, and the hub is rotated to swing the vehicles around the tower, as illustrated in FIG. 2. A static or neutral vector 72 is defined by the weight of each vehicle and the centrifugal force generated by rotating the vehicle about the vertical axis at a given velocity. In the absence of lift, each vehicle remains on this static vector 72 and follows a circular path around the tower. However, when the wings are shifted away from the neutral position to increase the angle of attack in either the inboard or outboard direction, lift is generated which acts on the vehicle, moving it either above or below the static vector.

As the speed of rotation of the hub increases, the centrifugal force on each vehicle also increases, reducing the effect of the lift generated by the wings in a given orientation. As such, the range of movement of the vehicle above or below the static vector decreases with increasing hub speeds. However, for a given hub speed, the range of movement of the vehicles relative to the static vector increases with increased ambient wind conditions. Thus, wind provides a free additive to the experience of the riders, and gives the ride a different "feel" under varying ambient conditions.

Figure 9:
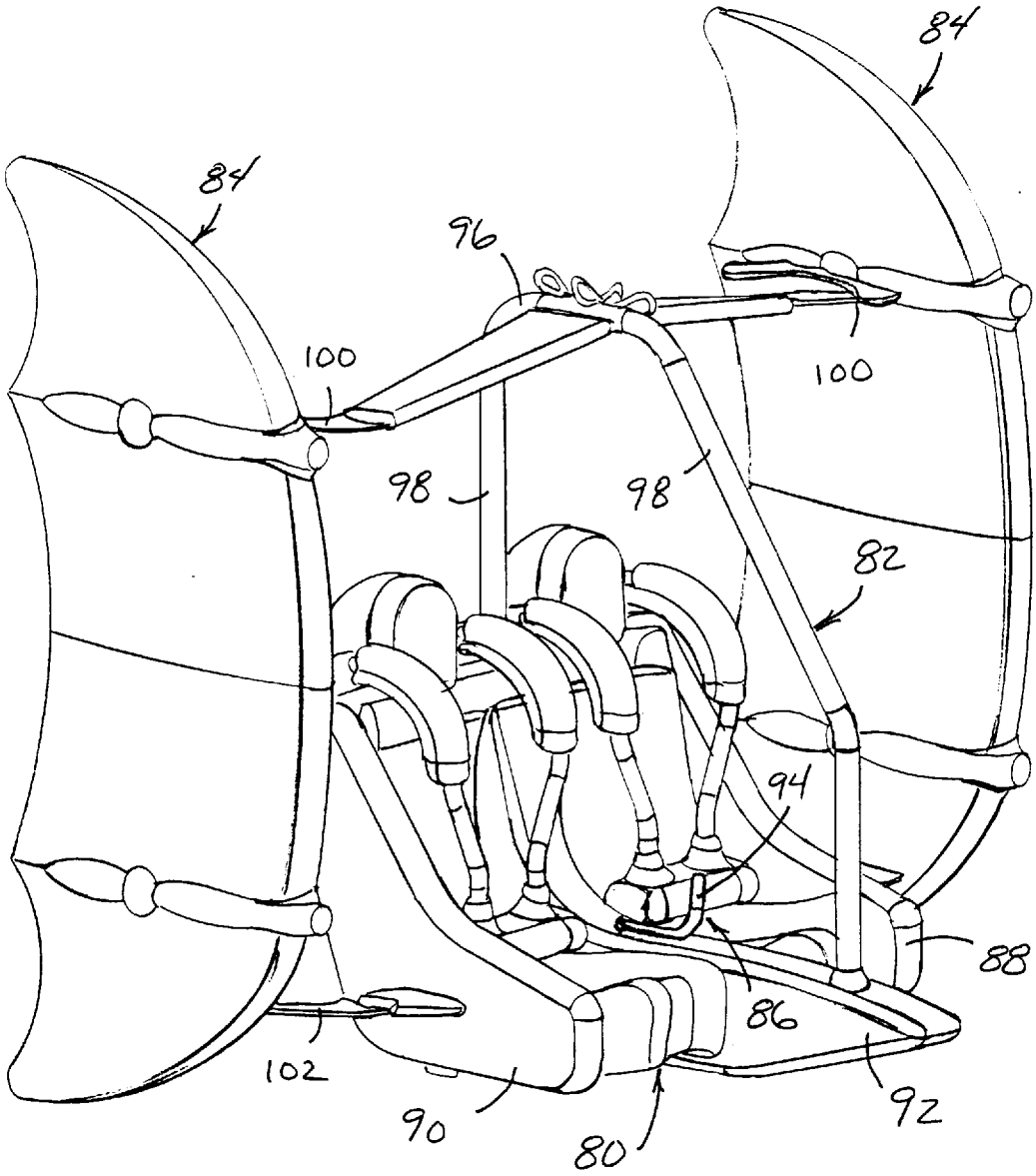
FIG. 9 is a side perspective view of an alternate construction of the flying vehicle.

An alternate construction of the flying vehicle is illustrated in FIG. 9, and broadly includes a seat 80, an inverted U-shaped frame 82 that is suspended between two of the sweeps by a pair of cables, a pair of laterally spaced, vertically extending wings 84 connected to the seat and frame for relative shifting movement about substantially vertical, parallel axes, and a control mechanism 86 for controlling the movement of the wings.

The seat 80 is preferably formed of synthetic resin material or fiberglass, and includes side-by-side seating for two riders. The seat presents inboard and outboard sides 88, 90, as well as a front side presenting a protruding nose 92, and an opposing back or tail side. In addition, skids may be provided beneath the seat for supporting the seat above the ground during loading. A center console is provided on the seat, and a handle 94 of the control mechanism 86 is supported on the console within easy access by either rider.

The U-shaped frame 82 includes an upper bar 96 and two depending legs 98. The vehicle is suspended from the sweeps so that the upper bar extends from front to back, with the lower ends of the legs 98 of the frame secured to the front and back sides of the seat. The upper bar includes holes by which the frame is connected to the two cables suspended from adjacent sweeps of the hub.

The wings 84 are substantially identical to one another, and each is connected to the seat and frame of the vehicle by upper and lower hinges 100, 102 which permit the wing to pivot about a substantially vertical axis that is defined by the hinges. As with the above-described vehicle, upper and lower stabilizer bars preferably extend between and connect the wings together, and maintain the wings substantially parallel to one another at all times. The stabilizer bars are secured to the wings through pivot pins that permit the wings to pivot about the hinges while maintaining the wings parallel.

Each wing 84 includes a cross-sectional profile presenting a center chord and symmetrical inboard and outboard airfoil surfaces that produce lift when the angle of attack of the wing is increased by pivoting the wing about the hinges. The symmetrical shape is required to provide lift in both lateral directions of the vehicle so that the riders are able to direct the vehicle either higher or lower relative to the ground than would otherwise be possible. One of the wings, preferably the inboard wing, is spaced forward of the other wing relative to the seat in order to improve the lift generated by the wings during rotation of the vehicle about the vertical axis.

The control mechanism 86 is the same as in the preveiously described construction, and can be either mechanical, pneumatic or electrical, depending on the application. Thus, manipulation of the handle 94 controls the direction of lift acting on the vehicle.

Although the present invention has been described with reference to the preferred embodiment, it is noted that equivalents may be employed and substitutions made herein without departing from the scope of the invention as recited in the claims. For example, although the invention is described with reference to a mobile trailer-mounted ride that is portable, it could also be designed as a permanent park fixture, including a rigid base secured to a foundation, and an upstanding tower that is fixed to the base. As such, the size of the ride and the height of the tower could be made to any desired dimensions, without consideration for over-the-road transportation of the ride.

What is claimed is:

1. A flying vehicle ride comprising:

an upstanding tower defining a vertical axis:

a plurality of sweeps supported on the tower for rotation about the vertical axis:

a drive means for driving rotation of the sweeps: and a flying vehicle suspended from the sweeps and including a pair of wings that are movable between a neutral position, a first lift generating position in which the wings generate outward lift, and a second lift generating position in which the wings generate inward lift, a frame having hinges on which the wings are mounted for relative pivoting movement, the hinges defining a substantially vertical pivot axis for each wing, and a manually actuated control means for controlling movement of the wings between the neutral and lift generating positions.

2. A flying vehicle ride as recited in claim 1, further comprising a hub supported on the tower for rotation about the vertical axis, and a drive means for driving rotation of the hub, the sweeps being fixed to the hub for rotation therewith.

3. A flying vehicle ride as recited in claim 1, further comprising a pair of cables for suspending the vehicle from two of the sweeps so that the vehicle travels along a circular path when the sweeps are rotated about the vertical axis with the wings in the neutral position, the cables permitting the vehicle to swing outward and inward of the circular path when the wings are moved to the first and second lift generating positions.

4. A flying vehicle ride as recited in claim 1, wherein the frame has a seat for accommodating an occupant, the control means including a handle accessible to the occupant and a moving means for moving the wings between the neutral and lift generating positions when the handle is manipulated.

5. A flying vehicle ride as recited in claim 4, wherein the moving means includes a mechanical linkage extending between the handle and the wings.

6. A flying vehicle ride as recited in claim 1, wherein one of the wings leads the other in the direction of travel of the vehicle.

7. A flying vehicle ride as recited in claim 1, wherein each wing defines a chord, and presents a symmetrical profile about the chord.

8. A flying vehicle ride as recited in claim 1, further comprising a stabilizer bar extending between and connecting the wings together.

9. A flying vehicle ride as recited in claim 1, wherein the frame has a seat for accommodating a pair of side-by-side occupants.

10. A vehicle for a flying vehicle ride, comprising:

a frame including a seat having left and right sides:

a pair of wings that are moveable together between a neutral position, a first lift generating position in which the wings generate leftward lift, and a second lift generating position in which the wings generate rightward lift, wherein one of the wings is displaced forward of the other wing relative to the frame; and a manually actuated control means for controlling movement of the wings between the neutral and lift generating positions.

11. A vehicle for a flying vehicle ride, comprising:

a frame including a seat having left and right sides:

a pair of wings that are moveable together between a neutral position, a first lift generating position in which the wings generate leftward lift, and a second lift generating position in which the wings generate rightward lift, wherein the frame includes hinges on which the wings are mounted for relative pivoting movement, the hinges defining a substantially vertical pivot axis for each wing, and a manually actuated control means for controlling movement of the wings between the neutral and lift generating positions.

12. A vehicle as recited in claim 11, further comprising a seat for accommodating an occupant, the control means including a handle accessible to the occupant and a moving means for moving the wings between the neutral and lift generating positions when the handle is manipulated.

13. A vehicle as recited in claim 11, wherein each wing defines a chord, and presents a symmetrical profile about the chord.

14. A vehicle as recited in claim 11, further comprising a stabilizer bar extending between and connecting the wings together.

15. A vehicle as recited in claim 11, wherein the frame includes a seat for accommodating a pair of side-by-side occupants.

* * * * *